US010982877B2

(12) United States Patent
Uzawa et al.

(10) Patent No.: US 10,982,877 B2
(45) Date of Patent: Apr. 20, 2021

(54) HEAT SOURCE UNIT FOR REFRIGERATION DEVICE

(71) Applicant: DAIKIN INDUSTRIES, LTD., Osaka (JP)

(72) Inventors: Aika Uzawa, Osaka (JP); Toshihiro Nagashima, Osaka (JP)

(73) Assignee: DAIKIN INDUSTRIES, LTD., Osaka (JP)

( * ) Notice: Subject to any disclaimer, the term of this patent is extended or adjusted under 35 U.S.C. 154(b) by 0 days.

(21) Appl. No.: 16/492,738

(22) PCT Filed: Mar. 5, 2018

(86) PCT No.: PCT/JP2018/008363
§ 371 (c)(1),
(2) Date: Sep. 10, 2019

(87) PCT Pub. No.: WO2018/180253
PCT Pub. Date: Oct. 4, 2018

(65) Prior Publication Data

US 2020/0386439 A1 Dec. 10, 2020

(30) Foreign Application Priority Data

Mar. 30, 2017 (JP) ..... JP2017-068281

(51) Int. Cl.
*F24F 13/20* (2006.01)
*F24F 1/24* (2011.01)
(Continued)

(52) U.S. Cl.
CPC ..... *F24F 13/20* (2013.01); *F24F 1/24* (2013.01); *F24F 1/16* (2013.01); *F24F 1/50* (2013.01); *F24F 1/56* (2013.01); *F24F 2013/207* (2013.01)

(58) Field of Classification Search
CPC ..... F24F 13/20; F24F 1/24; F24F 1/16; F24F 1/50; F24F 1/56; F24F 2013/207; F24F 2013/202; F24F 13/22
(Continued)

(56) References Cited

U.S. PATENT DOCUMENTS

2013/0333409 A1 12/2013 Tanno et al.
2019/0072285 A1* 3/2019 Morikawa ..... F24F 1/16

FOREIGN PATENT DOCUMENTS

EP 1 684 022 A1 7/2006
JP 2010-210173 A 9/2010
(Continued)

OTHER PUBLICATIONS

International Search Report for PCT/JP2018/008363 dated May 15, 2018.

*Primary Examiner* — Ana M Vazquez
(74) *Attorney, Agent, or Firm* — Birch, Stewart, Kolasch & Birch, LLP.

(57) ABSTRACT

A casing of a heat source unit for a refrigeration device is configured to allow air to flow from a machine chamber disposed at a lower portion of the casing to a heat exchange chamber disposed above the machine chamber. An electric component box includes a bottom panel, a side panel which has a vent opening, a top panel, and a vent opening cover for covering the vent opening of the side panel. The vent opening cover is provided with a plurality of slits extending in the vertical direction at positions deviated from a portion opposed to the vent opening of the side panel.

20 Claims, 13 Drawing Sheets

(51) Int. Cl.
*F24F 1/16* (2011.01)
*F24F 1/50* (2011.01)
*F24F 1/56* (2011.01)

(58) Field of Classification Search
USPC ..... 62/324.1
See application file for complete search history.

(56) References Cited

FOREIGN PATENT DOCUMENTS

| | | | |
|---|---|---|---|
| JP | 2014-240727 | A | 12/2014 |
| WO | WO 2005/031219 | A1 | 4/2005 |
| WO | WO 2011/013672 | A1 | 2/2011 |

* cited by examiner

HEAT SOURCE UNIT FOR REFRIGERATION DEVICE

TECHNICAL FIELD

The present disclosure relates to a heat source unit for a refrigeration device.

BACKGROUND ART

Patent Document 1 discloses a heat source unit for a refrigeration device. The heat source unit includes a machine chamber at a lower portion thereof, and a heat exchange chamber at an upper portion thereof. Devices, such as a compressor and an electric component box, are disposed in the machine chamber. A heat exchanger and a fan are disposed in the heat exchange chamber.

In this type of heat source unit, the water condensed on the ceiling of the machine chamber may drip onto the electric component box when, for example, the temperature in the machine chamber is increased. In addition, during rainfall, water that has entered into the machine chamber, i.e., a lower chamber where the compressor and the electric component box are located, from the heat exchange chamber, i.e., an upper chamber where the heat exchanger is located, may drip onto the electric component box. It is therefore necessary to ensure waterproofness of the electric component box. To address this issue, in this type of heat source unit, sheet metal parts of the electric component box may be caulked, or outer surfaces of the electric component box may be coated.

CITATION LIST

Patent Documents

Patent Document 1: Brochure of WO 2011/013672

SUMMARY OF THE INVENTION

Technical Problem

However, coating or caulking of parts of the electric component box may increase the cost of the electric component box, and thus may increase the cost of the heat source unit. Further, coating or caulking may decrease the heat dissipating properties of the electric components housed in the electric component box.

Thus, in such a conventional heat source unit, it is difficult to ensure waterproofness of the electric component box disposed in the machine chamber, i.e., the lower chamber, without impairing its heat dissipating properties.

It is therefore an object of the present disclosure to provide a heat source unit which has a heat exchanger at an upper portion, and a compressor and an electric component box at a lower portion, and which keeps the waterproofness of the electric component box from decreasing while ensuring the heat dissipating properties of the electric component box.

Solution to the Problem

A first aspect of the present disclosure is directed to a heat source unit for a refrigeration device. The heat source unit includes: a casing (30) including: a machine chamber (31A to 31D) in which components, including a compressor (11), of a refrigerant circuit and an electric component box (20) are disposed; and a heat exchange chamber (32A to 32D) in which a heat exchanger (15, 16) allowing heat exchange between a refrigerant and air is disposed, the casing (30) being configured to allow air to flow from the machine chamber (31A to 31D) disposed at a lower portion of the casing (30) to the heat exchange chamber (32A to 32D) disposed above the machine chamber (31A to 31D).

In the heat source unit of the refrigeration device, the electric component box (20) includes a bottom panel (21), a side panel (22) which has a lower end connected to the bottom panel (21) and which has a vent opening (23), a top panel (24) which closes an upper end of the side panel (22), and a vent opening cover (25) for covering the vent opening (23) of the side panel (22). The vent opening cover (25) is provided with a plurality of slits (26) extending in a vertical direction at positions deviated from a portion opposed to the vent opening (23) of the side panel (22).

In the first aspect, heat generated inside the electric component box (20) is dissipated to the outside of the electric component box (20) through the vent opening (23) of the side panel (22) and the slits (26) of the vent opening cover (25). On the other hand, when water, such as dew condensation water or rainwater falls onto the electric component box (20), the water flows downward along the slits (26).

A second aspect of the present disclosure is an embodiment of the first aspect. In the second aspect, an opening area of the slits (26) of the vent opening cover (25) is equal to or larger than an opening area of the vent opening (23) formed in the side panel (22).

In the second aspect, the opening area of the slits (26) of the vent opening cover (25) is equal to or larger than the opening area of the vent opening (23) formed in the side panel (22). This configuration substantially prevents the vent opening cover (25) from increasing the resistance of air flowing out of the electric component box (20), and thus avoids a reduction in dissipating properties.

A third aspect of the present disclosure is an embodiment of the first or second aspect. In the third aspect, lower ends of the slits (26) of the vent opening cover (25) are located below a lower end of the vent opening (23) of the side panel (22).

In the third aspect, when water such as dew condensation water falls onto the electric component box (20), the water flows down along the slits (26) and reaches to the lower ends of the slits (26). The lower ends of the slits (26) are located below the lower end of the vent opening (23) of the side panel (22) of the electric component box (20). Thus, even if the water enters the inside of the vent opening cover (25), the water is less likely to enter into the electric component box (20) from the vent opening (23).

A fourth aspect of the present disclosure is an embodiment of any one of the first to third aspects. In the fourth aspect, the top panel (24) has a water entry preventing part (27) at an outer edge portion, the water entry preventing part (27) protruding outward beyond an upper end of the vent opening cover (25) attached to the side panel (22).

In the fourth aspect, the outer edge portion of the top panel (24) constitutes the water entry preventing part (27) which protrudes outward beyond the upper end of the vent opening cover (25). The water entry preventing part (27) serves as eaves. Water falling onto the electric component box (20) from above is therefore less likely to adhere to the side panel (22) and the vent opening cover (25). The waterproofness of the electric component box (20) is therefore increased.

A fifth aspect of the present disclosure is an embodiment of any one of the first to fourth aspects. In the fifth aspect, the electric component box (20) is provided with a water entry inhibiting member (28) which inhibits entry of water into the electric component box (20) from a lateral side of the vent opening (23) of the side panel (22).

In the fifth aspect, even if the water which has fallen onto the electric component box (20) enters the inside of the vent opening cover (25), the water is less likely to enter into the electric component box (20) from a lateral side of the vent opening (23) due to the water entry inhibiting member (28).

A sixth aspect of the present disclosure is an embodiment of the fifth aspect. In the sixth aspect, the water entry inhibiting member (28) is comprised of a member having an L-shaped cross section extending in the vertical direction along a side edge of the vent opening (23) formed in the side panel (22). The water entry inhibiting member (28) is fixed to the side panel (22) such that one side of the L-shaped member is fixed to the side panel (22).

In the sixth aspect, the water entry inhibiting member (28) comprised of a member having an L-shaped cross section is attached to a side surface of the electric component box (20). Thus, even if the water which has fallen onto the electric component box (20) enters the inside of the vent opening cover (25), the water is less likely to enter into the electric component box (20) from a lateral side of the vent opening (23).

A seventh aspect of the present disclosure is an embodiment of any one of the first to sixth aspects. In the seventh aspect, the bottom panel (21) is provided with an air intake opening (29) through which air flows into the electric component box (20) from outside of the electric component box (20). The vent opening (23) of the side panel (22) of the electric component box (20) is an air outlet opening through which air flows out of an interior of the electric component box (20).

In the seventh aspect, air flows into the electric component box (20) through the air intake opening (29) formed in the bottom panel (21) of the electric component box (20), and the air flows out of the electric component box (20) through the vent opening (23) of the side panel (22). The smooth airflow is achieved in this manner.

Advantages of the Invention

According to the first aspect, heat generated inside the electric component box (20) is dissipated to the outside of the electric component box (20) through the vent opening (23) of the side panel (22) and the slits (26) of the vent opening cover (25). A dedicated fan is not necessary because air flows toward the heat exchange chamber (32A to 32D) from the machine chamber (31A to 31D) and the same air cools the electric component box (20). Further, when water, such as dew condensation water or rainwater, falls onto the electric component box (20), the water flows downward along the slits (26), so that the water is less likely to enter into the electric component box (20). It is therefore possible to keep the waterproofness of the electric component box (20) from decreasing, while ensuring the heat dissipating properties of the electric component box (20).

According to the second aspect, the opening area of the slits (26) of the vent opening cover (25) is equal to or larger than the opening area of the vent opening (23) formed in the side panel (22) of the electric component box (20). This configuration keeps the resistance of air flowing out of the electric component box (20) from increasing. The heat dissipation of the electric component box (20) is therefore less likely to be inhibited by the vent opening cover (25).

According to the third aspect, the slits (26) of the vent opening cover (25) are formed such that the lower ends thereof are located below the lower end of the vent opening (23) of the side panel (22) of the electric component box (20). The water that has fallen onto the electric component box (20) flows down along the slits (26) to the lower ends of the slits (26). As such, even if the water enters the inside of the vent opening cover (25) from the lower ends of the slits (26), the water is less likely to enter into the electric component box (20) from the vent opening (23) which is higher in position than the lower ends of the slits (26). The waterproofness of the electric component box (20) is therefore improved.

According to the fourth aspect, the outer edge portion of the top panel (24) constitutes the water entry preventing part (27) which protrudes outward beyond the upper end of the vent opening cover (25). The water entry preventing part (27) serves as eaves. Water falling onto the electric component box (20) from above is therefore less likely to adhere to the side panel (22) and the vent opening cover (25). As such, the waterproofness of the electric component box (20) is less likely to decrease.

In the fifth aspect, even if the water which has fallen onto the electric component box (20) enters the inside of the vent opening cover (25), the water is less likely to enter into the electric component box (20) from a lateral side of the vent opening (23) due to the water entry inhibiting member (28). The waterproofness of the electric component box (20) is therefore improved.

According to the sixth aspect, the water entry inhibiting member (28) comprised of a member having an L-shaped cross section is attached to a side surface of the electric component box (20). Thus, even if the water which has fallen onto the electric component box (20) enters the inside of the vent opening cover (25), the water is less likely to enter into the electric component box (20) from a lateral side of the vent opening (23). The waterproofness of the electric component box (20) is therefore improved by the simple configuration.

According to the seventh aspect, air flows into the electric component box (20) through the air intake opening (29) formed in the bottom panel (21) of the electric component box (20), and the air flows out of the electric component box (20) through the vent opening (23) of the side panel (22). The smooth airflow is achieved in this manner. The heat dissipating properties of the electric component box (20) are therefore improved.

DESCRIPTION OF EMBODIMENTS

An embodiment will now be described in detail with reference to the drawings. The following embodiments and variations are merely beneficial examples in nature, and are not intended to limit the scope, applications, or use of the present disclosure.

The chiller unit (1) of this embodiment constitutes a heat source unit of an air conditioner which is a refrigeration device. The chiller unit (1) has a refrigerant circuit in which a refrigerant is circulated to perform a refrigeration cycle, and is configured to cool or heat heat medium water by the refrigerant. The heat medium water cooled or heated in the chiller unit (1) is supplied to a fan coil unit (not shown) and is used to cool or heat the indoor space.

Now, a detailed structure of the chiller unit (1) will be described. Note that the terms in the following description which indicate directions, such as "front," "rear," "right," "left," "upper," "top," "lower," and "bottom" refer to the directions shown in FIG. 1 unless otherwise specified.

Figure 1:
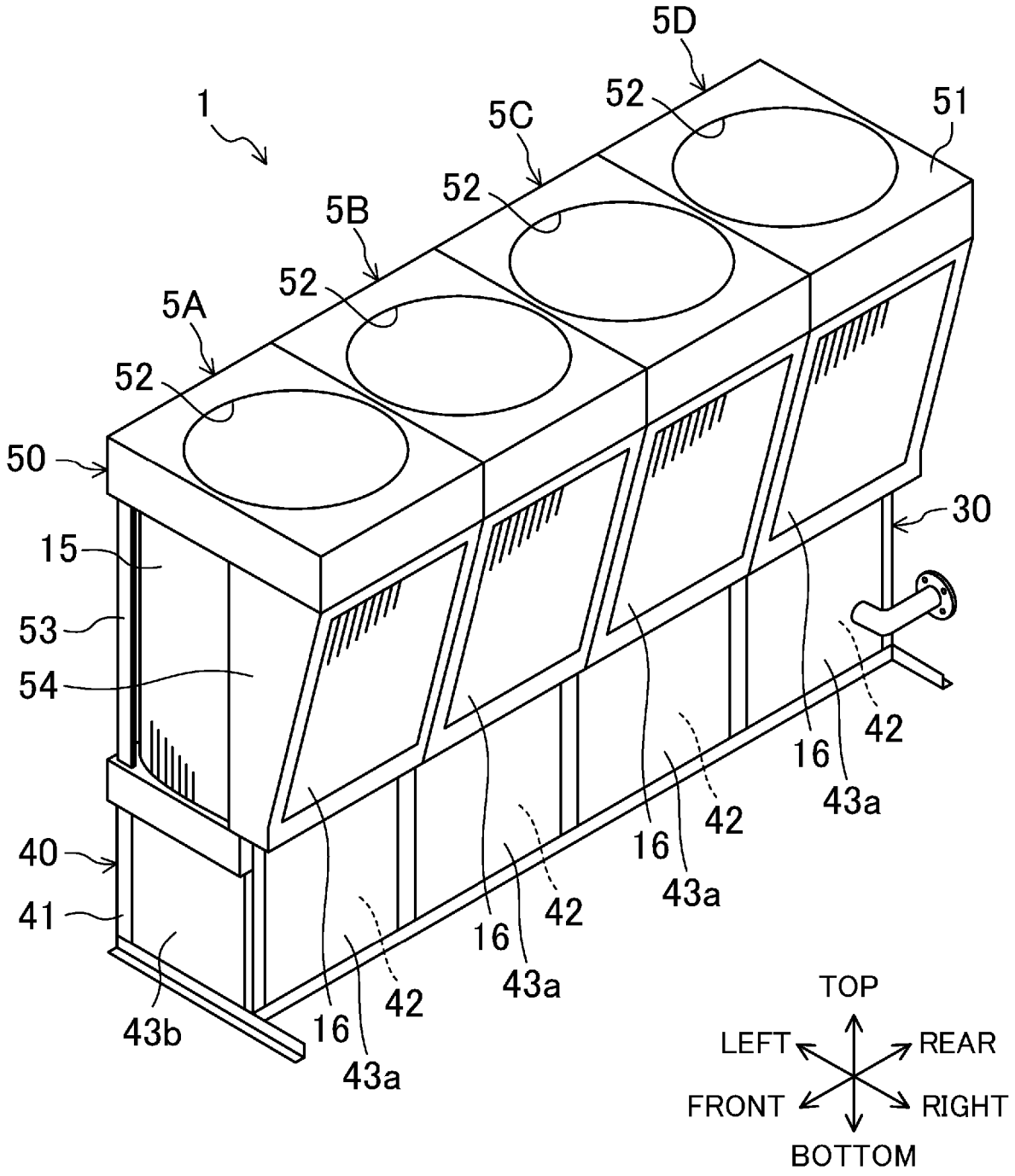
FIG. 1 is a diagram illustrating a perspective view of an entire chiller unit, showing the front and right sides of the chiller unit.
Figure 2:
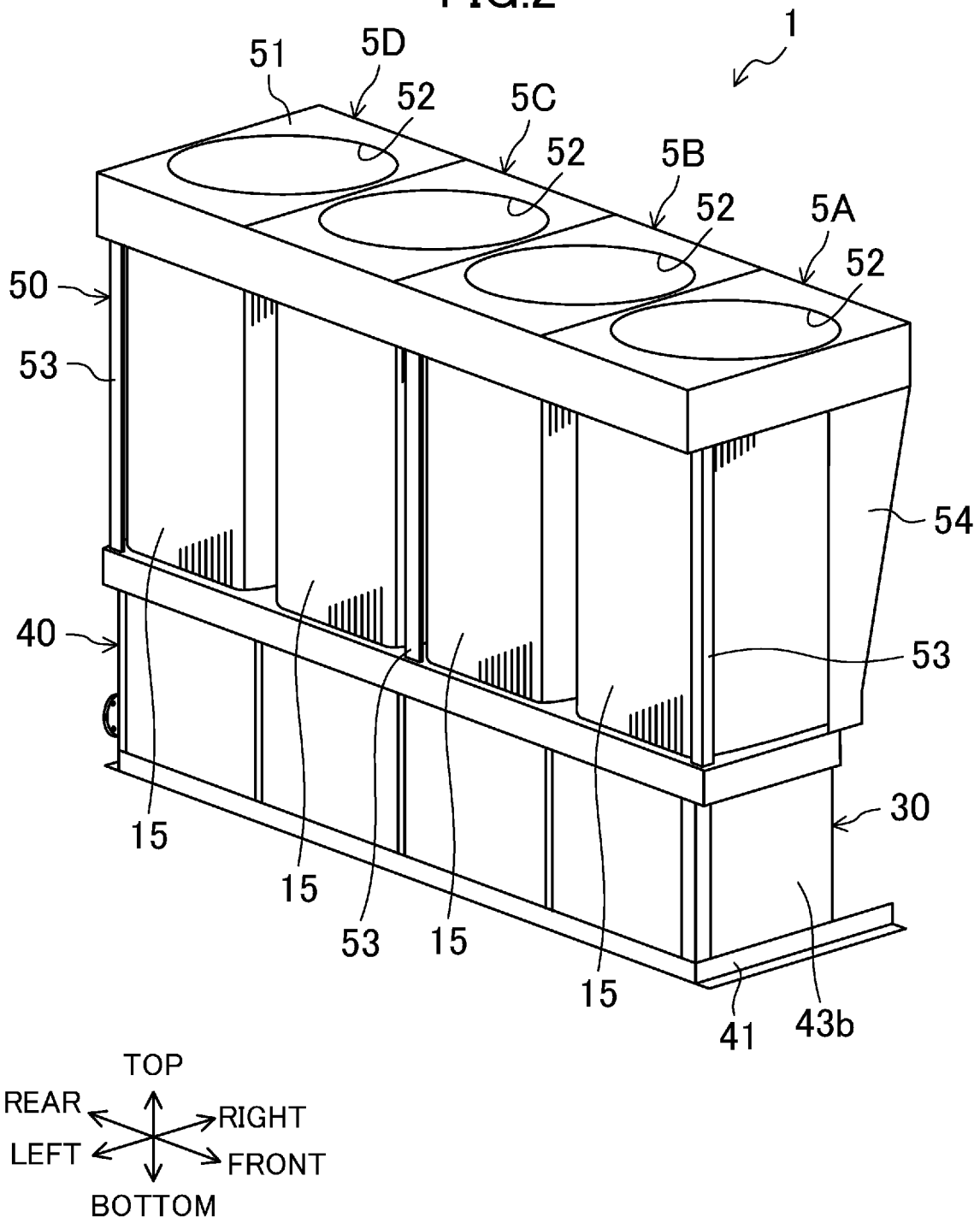
FIG. 2 is a diagram illustrating a perspective view of the entire chiller unit, showing the front and left sides of the chiller unit.

As shown in FIGS. 1 and 2, the chiller unit (1) is long in the front-rear direction. The chiller unit (1) is divided into four subunits (5A, 5B, 5C, and 5D). In the chiller unit (1), the first subunit (5A), the second subunit (5B), the third subunit (5C), and the fourth subunit (5D) are sequentially aligned from the front side to the rear side of the chiller unit (1). As will be described in detail later, the four subunits (5A to 5D) each include a compressor (11), an electric component box (20) (i.e., a system electric component box (20A)), a first air heat exchanger (15), a second air heat exchanger (16), and a fan (17).

<Casing>

As shown in FIGS. 1 and 2, the chiller unit (1) has a casing (30) which is long in the front-rear direction. The casing (30) is provided with a lower casing (40) and an upper casing (50) arranged above the lower casing (40).

The lower casing (40) is formed in a rectangular parallelepiped shape that is long in the front-rear direction. The lower casing (40) is provided with one support frame (41) and a plurality of side panels. The support frame (41) is a frame in a rectangular parallelepiped shape, and is long in the front-rear direction. The side panels are provided on the front, rear, right, and left side surfaces of the support frame (41) so as to cover each side surface of the support frame (41). The internal space of the lower casing (40) constitutes machine chambers (31A, 31B, 31C, and 31D) of the subunits (5A, 5B, 5C, and 5D).

In the lower casing (40), four side panels (43*a*) corresponding to the respective subunits (5A to 5D) are detachably attached to the right side surface of the support frame (41). The right side surface of the support frame (41) serves as a maintenance opening (42) covered with the side panels (43*a*) which are detachable from, and attachable to, the support frame (41). In other words, the four maintenance openings (42) corresponding to the respective subunits (5A to 5D) are formed on the right side surface of the lower casing (40).

Figure 3:
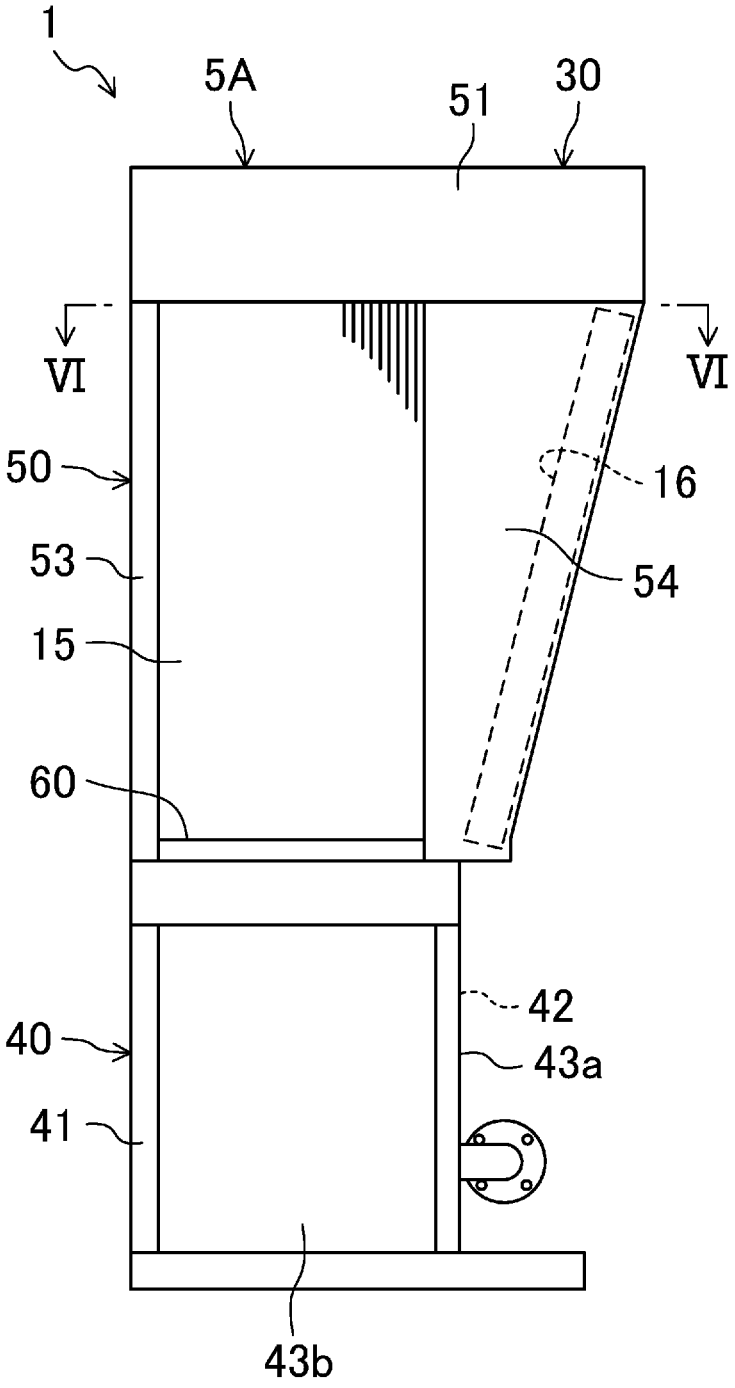
FIG. 3 is a diagram illustrating a front view of the chiller unit.

The upper casing (50) is in a box-like shape that is long in the front-rear direction. As shown in FIG. 3, the upper casing (50) has a pentagonal shape, when viewed from the front, in which the upper portion protrudes toward the right side of the casing. The upper casing (50) constitutes heat exchange chambers (32A, 32B, 32C, and 32D) which serve as air passages of the respective subunits (5A, 5B, 5C, and 5D).

Figure 4:
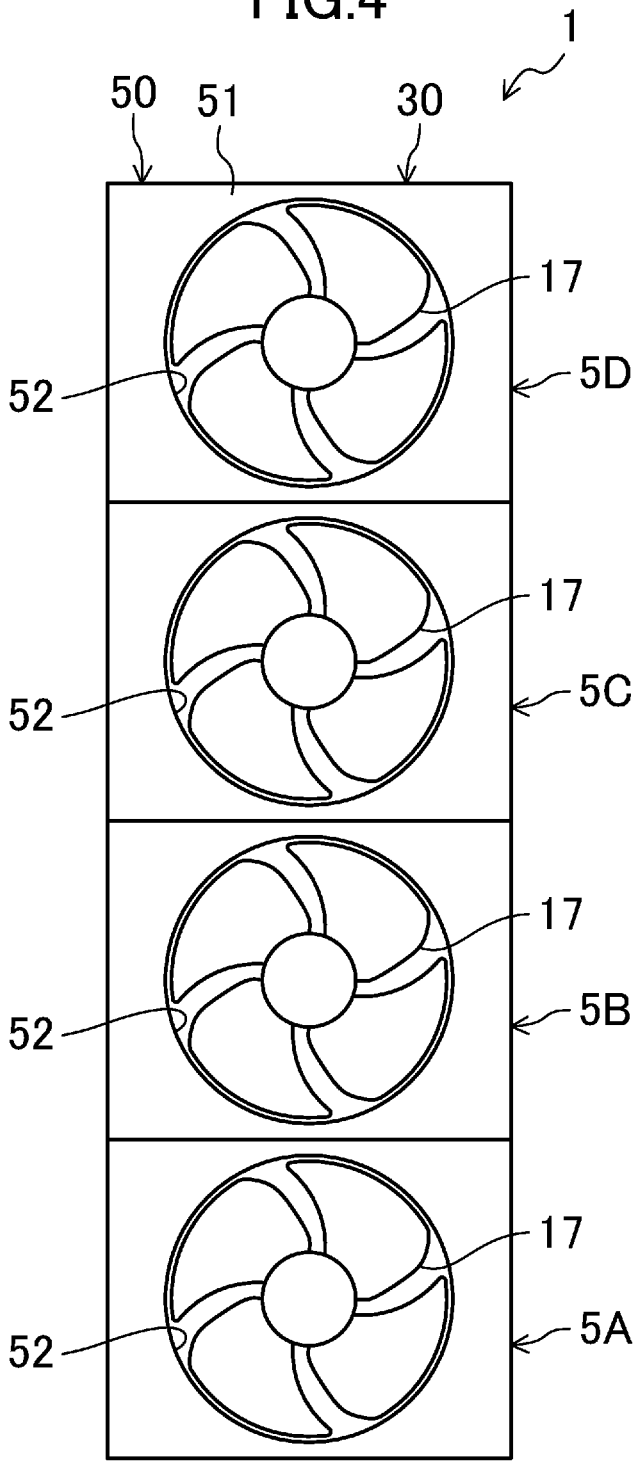
FIG. 4 is a diagram illustrating a plan view of the chiller unit.
Figure 5:
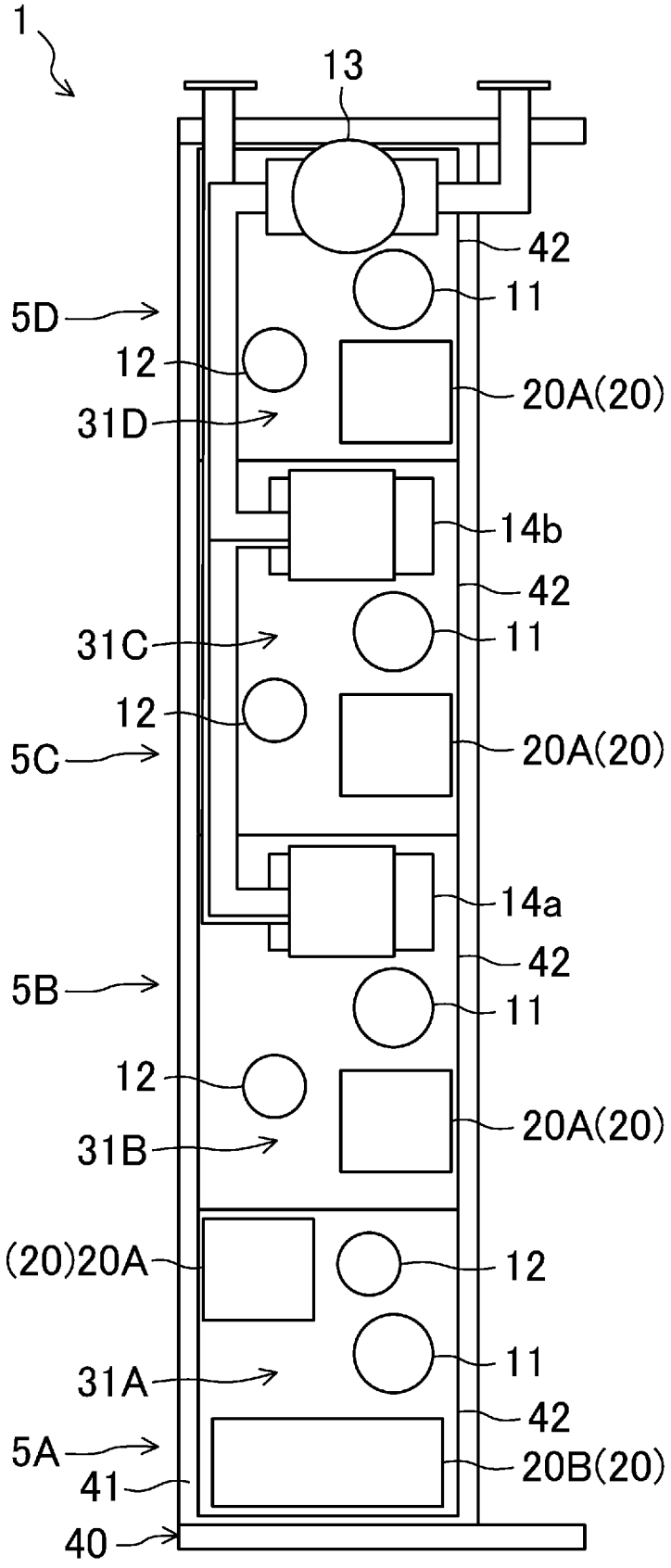
FIG. 5 is a diagram illustrating a plan view of the arrangement of main devices in machine chambers.

The upper casing (50) includes a fan housing (51), support columns (53), shielding plates (54, 55, and 56), and drain pans (60). The fan housing (51) is in a flat rectangular parallelepiped shape, and is disposed on the top of the upper casing (50). As shown in FIG. 4, four circular blowout openings (52) are formed in a top panel of the fan housing (51), and are aligned in the front-rear direction. A fan (17) of each of the subunits (5A to 5D) is disposed in associated one of the blowout openings (52). The support columns (53) are disposed between the fan housing (51) and the lower casing (40) to support the fan housing (51). The drain pans (60) are disposed at the bottom of the upper casing (50), and serve as partitioning members which separates the machine chambers (31A to 31D) and the heat exchange chambers (32A to 32D) of the respective subunits (5A to 5D) from one another.

<Arrangement of Devices in Machine Chamber>

A single compressor (11), a single receiver (12), and a single system electric component box (20A) are disposed in each of the machine chambers (31A to 31D) of the subunits (5A to 5D). The system electric component boxes (20A) of the respective subunits (5A to 5D) accommodate electric components, such as an inverter board for driving the compressors (11) of the respective subunits (5A to 5D).

A first water heat exchanger (14*a*) is disposed in the machine chamber (31B) of the second subunit (5B). A second water heat exchanger (14*b*) is disposed in the machine chamber (31C) of the third subunit (5C). The first water heat exchanger (14*a*) is shared by the first subunit (5A) and the second subunit (5B). The second water heat exchanger (14*b*) is shared by the third subunit (5C) and the fourth subunit (5D).

An operating electric component box (20B), which is another electric component box (20), is disposed in the machine chamber (31A) of the first subunit (5A). The operating electric component box (20B) houses an electric component, such as a control board having a CPU for controlling the operation of the compressor (11) or the like. The operating electric component box (20B) is shared by the four subunits (5A to 5D). A water pump (13) is disposed in the machine chamber (31D) of the fourth subunit (5D). The water pump (13) is used to circulate the heat source water between the chiller unit (1) and the fan coil unit, and is shared by the four subunits (5A to 5D).

<Shape of Heat Exchanger, Arrangement of Devices in Air Passage, and Shielding Plate>

A single first air heat exchanger (15), a single second air heat exchanger (16), and a single fan (17) are disposed in each of the heat exchange chambers (32A to 32D) of the respective subunits (5A to 5D).

Figure 6:
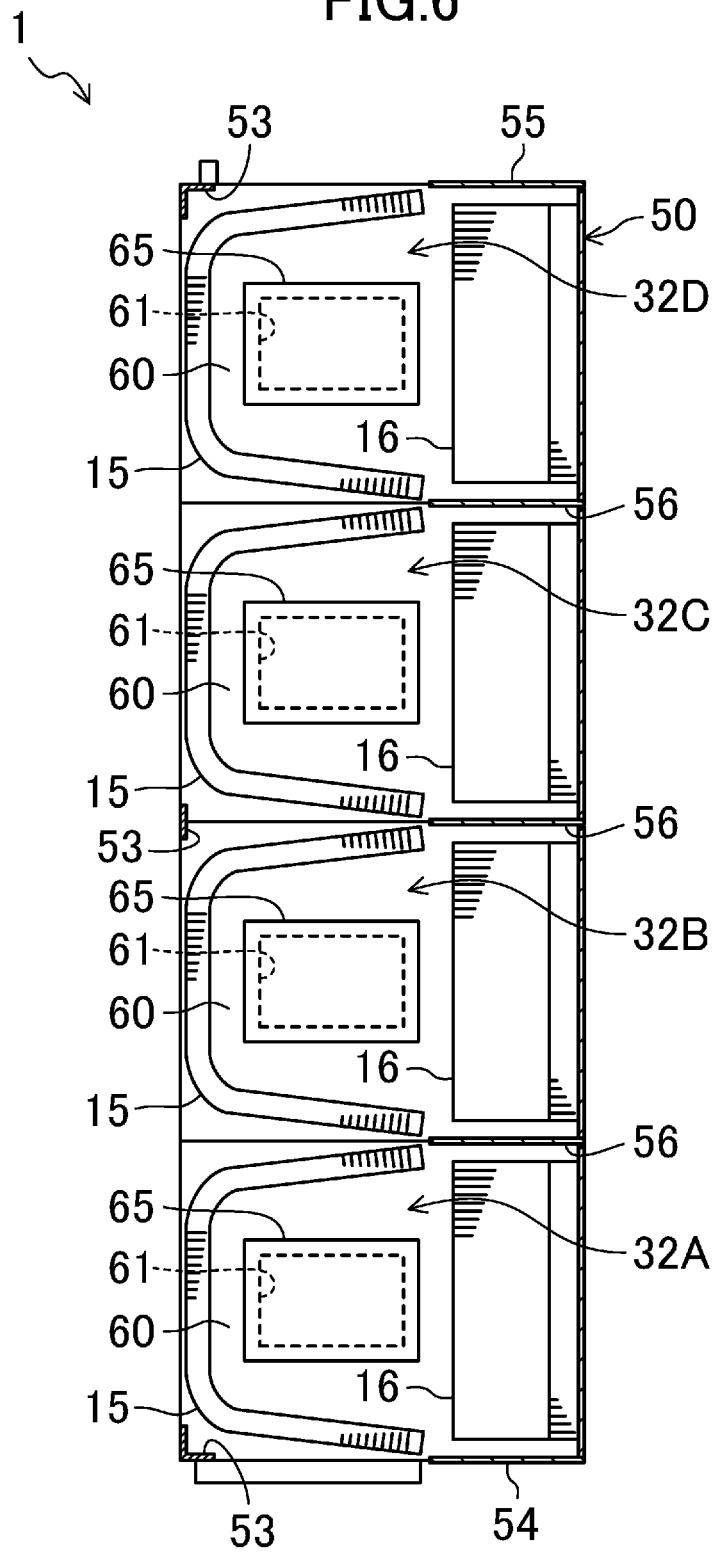
FIG. 6 is a diagram generally illustrating a cross-sectional view of the chiller unit taken along the line VI-VI in FIG. 3.

Each of the first air heat exchanger (15) and the second air heat exchanger (16) is a so-called cross-fin type fin-and-tube heat exchanger, and exchanges heat between a refrigerant and air. As shown in FIG. 6, the first air heat exchanger (15) has substantially a U shape in plan view. The first air heat exchangers (15) of the respective subunits (5A to 5D) are aligned along the left side surface of the casing (30) and in a posture that faces rightward in plan view. As shown in FIGS. 3 and 6, the second air heat exchanger (16) is in a flat plate-like shape. The second air heat exchangers (16) of the respective subunits (5A to 5D) are aligned along the right side surface of the casing (30) and in an inclined posture in which an upper end portion thereof is positioned more to the right than a lower end portion thereof.

Five shielding plates (54, 55, and 56) are provided in the upper casing (50). As shown in FIG. 3, each of the shielding plates (54, 55, and 56) is a plate-shaped member having substantially an inverted trapezoidal shape, and is provided so as to close a gap between the first air heat exchanger (15) and the second air heat exchanger (16). As shown in FIG. 6, the first shielding plate (54) is disposed at the front surface of the upper casing (50), and the second shielding plate (55) is disposed at the rear surface of the upper casing (50). The intermediate shielding plates (56) are disposed one by one between the first subunit (5A) and the second subunit (5B), between the second subunit (5B) and the third subunit (5C), and between the third subunit (5C) and the fourth subunit (5D).

As shown in FIG. 3, in each of the subunits (5A to 5D), the drain pan (60) is disposed under the first air heat exchanger (15) and the second air heat exchanger (16). Specifically, the drain pan (60) is provided so as to cover the lower end portion of the first air heat exchanger (15) and the lower end portion of the second air heat exchanger (16) from below.

<Drain Pan and Cover Member>

As described above, the drain pan (60) disposed below the heat exchanger (15 and 16) is disposed in the casing (30) as a partitioning member that separates the machine chamber (31A to 31D) formed in the lower portion of the casing (30) and the heat exchange chamber (32A to 32D) formed above the machine chamber from each other.

Figure 7:
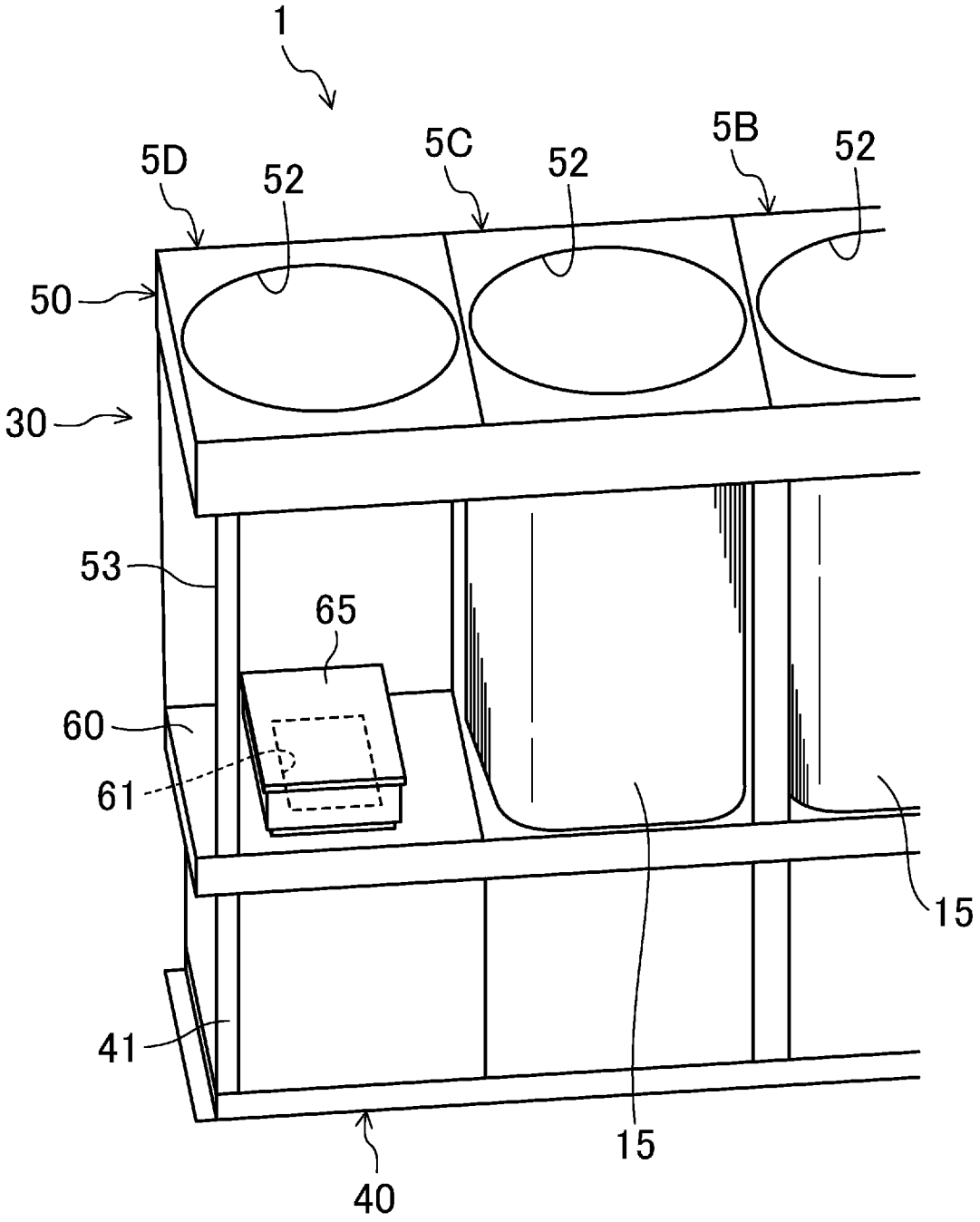
FIG. 7 is a diagram illustrating a partial perspective view of the chiller unit in a state in which a first heat exchanger of a fourth subunit is removed.
Figure 8:
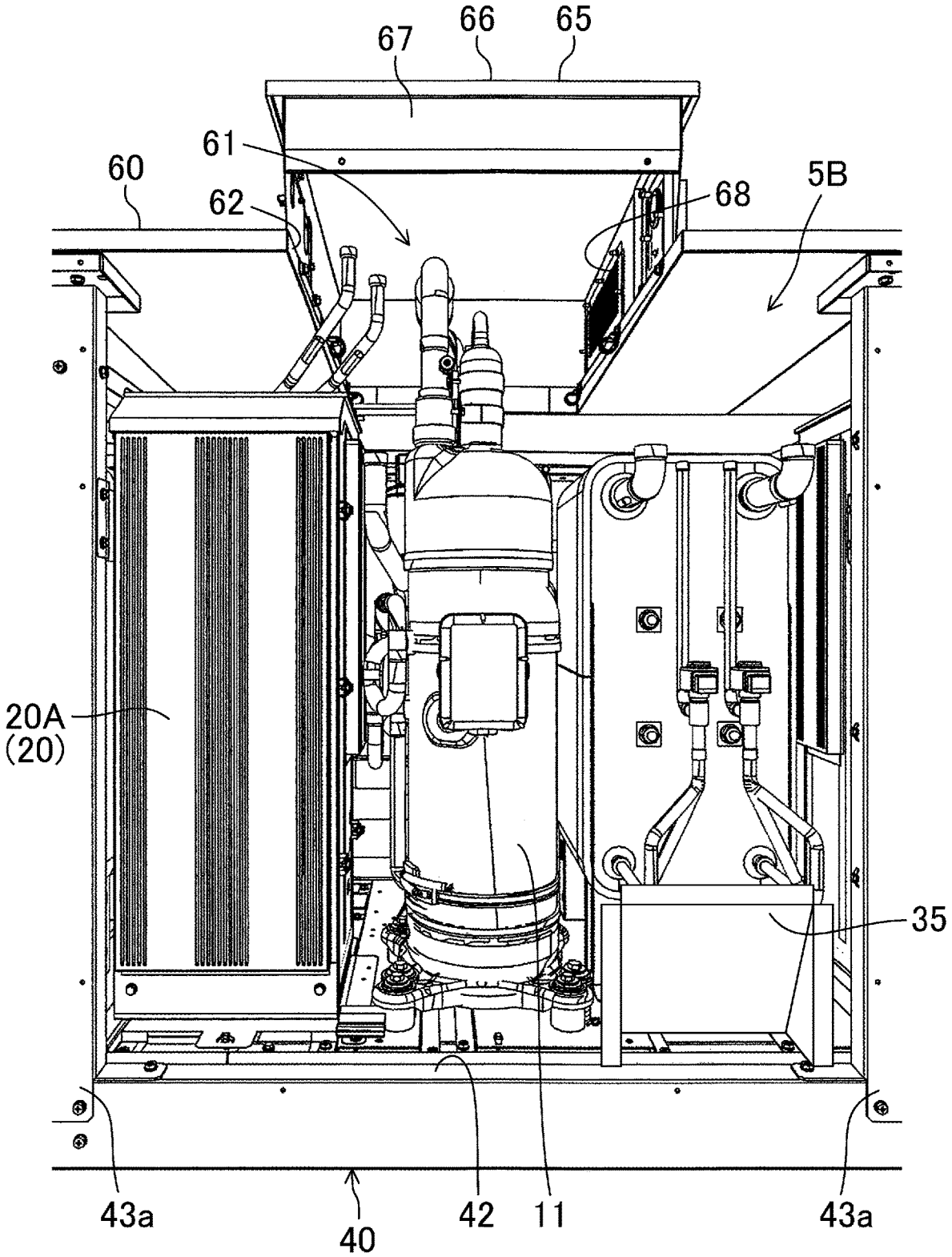
FIG. 8 is a diagram illustrating a perspective view of the machine chamber of a second subunit.
Figure 9:
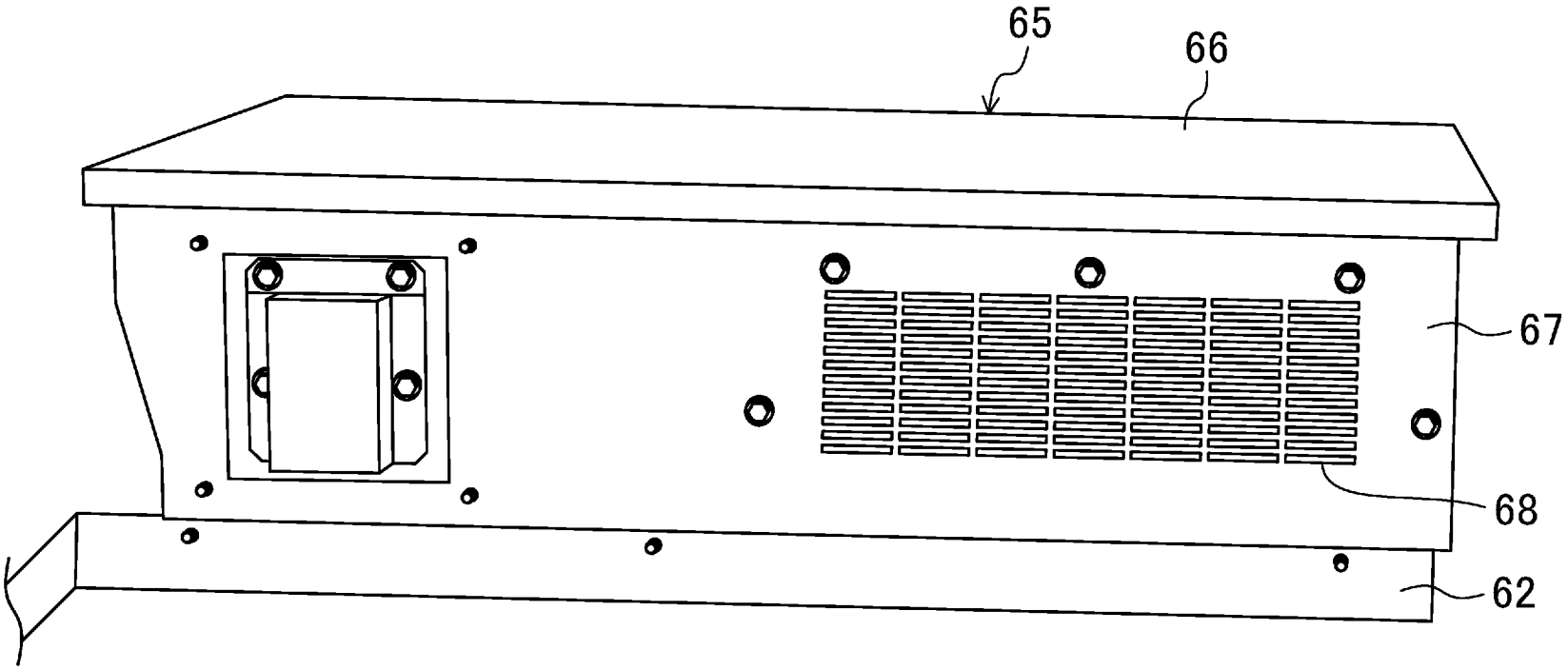
FIG. 9 is a diagram illustrating a perspective view of a cover member which covers an opening of a drain pan.
Figure 10:
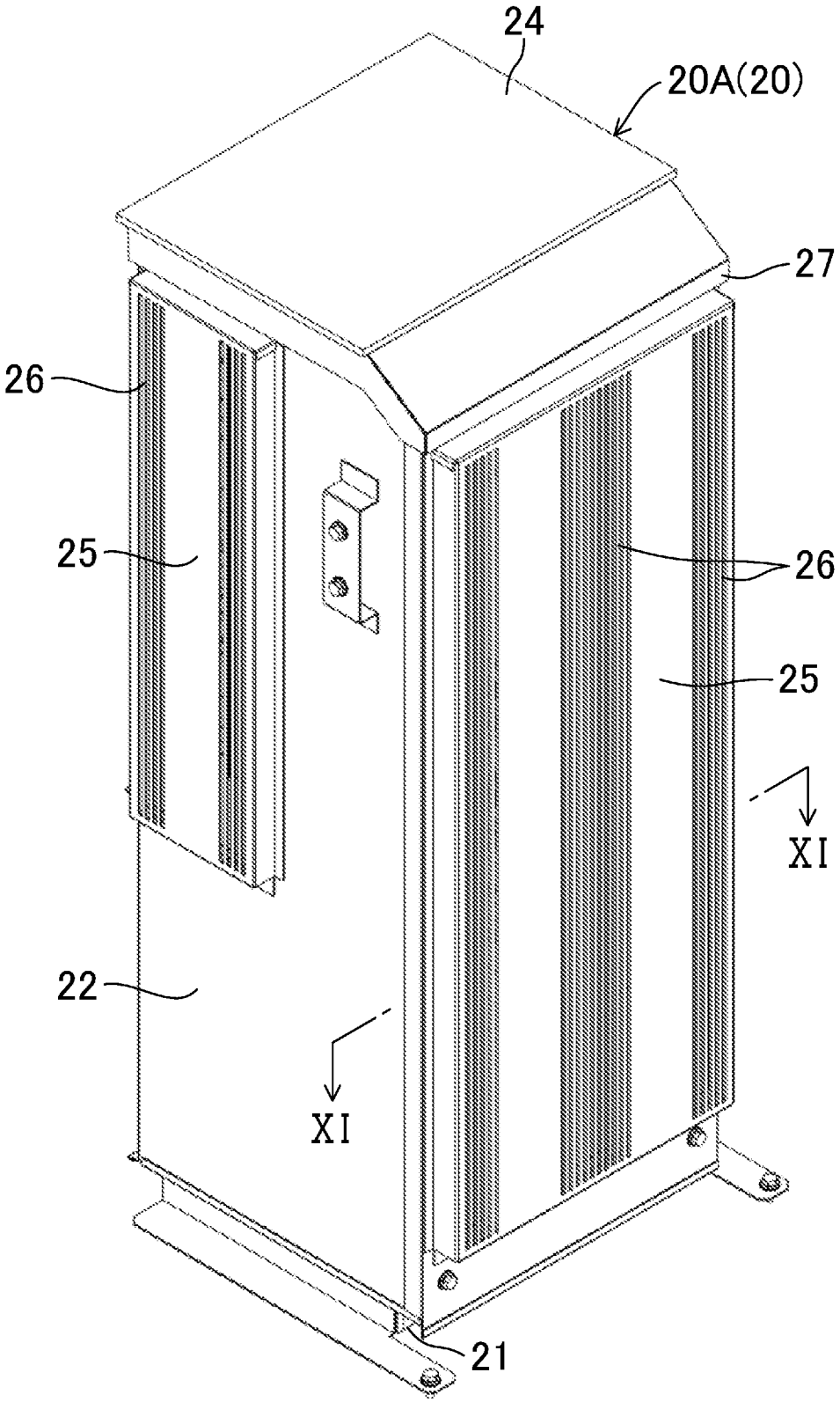
FIG. 10 is a diagram illustrating a perspective view of an external shape of an electric component box (i.e., a system electric component box).
Figure 11:
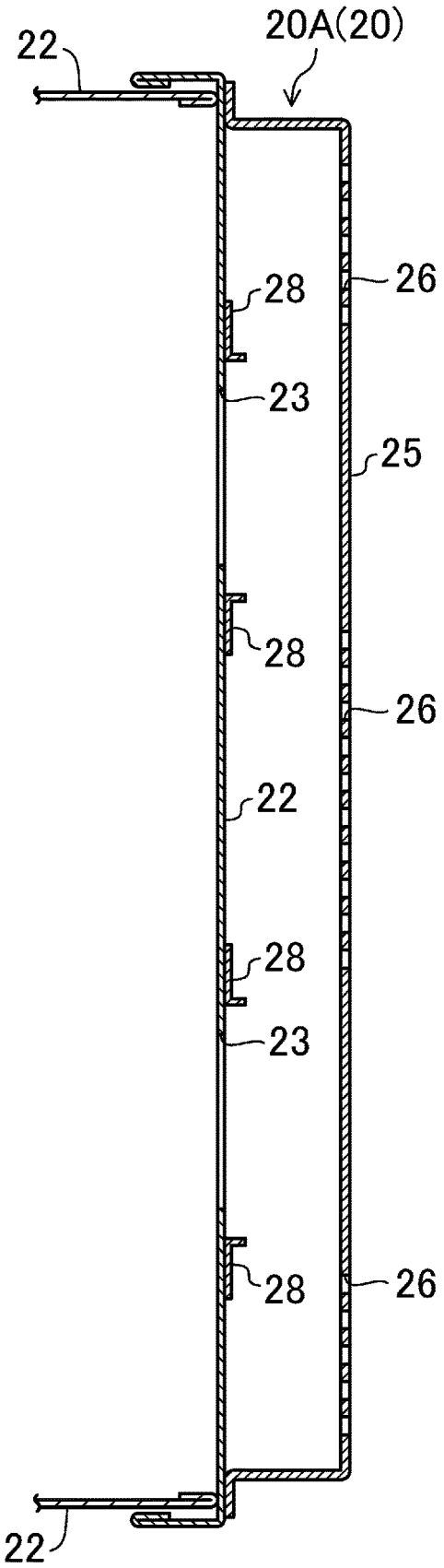
FIG. 11 is a diagram illustrating an enlarged cross-sectional view (a cross-sectional view taken along the line XI-XI in FIG. 10) of a configuration of the front side of the electric component box and a vent opening cover.

As shown in FIGS. 6 to 8, the drain pan (60) is provided with an opening (61) which allows the air to flow from the machine chamber (31A to 31D) to the heat exchange chamber (32A to 32D) at a central portion of the drain pan (60). A cover member (65) covering the opening (61) of the drain pan (60) is disposed in the heat exchange chamber (32A to 32D). As shown in FIG. 9, the cover member (65) includes a top panel (66) and a side panel (67) extending downward from an outer edge portion of the top panel (66) and having a lower end portion in contact with the drain pan (60). An air vent hole (68) is formed in a portion of the side panel (67).

The opening (61) of the drain pan (60) is formed at a position vertically above the compressor (11) disposed in the machine chamber (31A to 31D). The casing (30) is provided with an air-passage hole (35) in the vicinity of the compressor (11) disposed in the machine chamber (31A to 31D). Through the air-passage hole (35), air can flow into the casing (30) from outside of the casing (30). The air-passage hole (35) is formed in the lower casing (40). Thus, during the rotation of the fan (17), air which has flowed into the casing (30) through the air-passage hole (35) flows into the heat exchange chamber (32A to 32D) through the air vent hole (68) of the cover member (65), and is blown out of the casing (30) from the heat exchange chamber (32A to 32D).

<Electric Component Box>

As described above, the chiller unit (1) of the present embodiment includes a casing (30) having: the machine chamber (31A to 31D) in which components, including the compressor (11), of a refrigerant circuit and the electric component box (20) (i.e., the system electric component box (20A)) are disposed; and the heat exchange chamber (32A to 32D) in which the first and second heat exchangers (15 and 16) allowing heat exchange between the refrigerant and the air are disposed. The casing (30) is configured to allow air to flow from the machine chamber (31A to 31D) disposed at the lower portion of the casing (30) to the heat exchange chamber (32A to 32D) disposed above the machine chamber (31A to 31D). Note that only the system electric component box (20A) is illustrated in the drawings as the "electric component box (20)" in the following description, but the same configuration is applied to the operating electric component box (20B), as well.

The electric component box (20) shown in FIGS. 10 to 13 includes a bottom panel (21), a side panel (22) which has a lower end connected to the bottom panel (21) and which has a vent opening (23), and a top panel (24) which closes the upper end of the side panel (22). The electric component box (20) is also provided with a vent opening cover (25) for covering the vent opening (23) of the side panel (22). The vent opening cover (25) is provided with a plurality of slits (26) extending in the vertical direction at positions deviated from a portion opposed to the vent opening (23) of the side panel (22). Each slit (26) is a straight elongated opening with an opening width of 3 mm, for example. Since the opening width of the slit (26) is narrow, not only water but also insects and other foreign substances hardly enter into the electric component box.

The total opening area of the slits (26) of the vent opening cover (25) is equal to or larger than the opening area of the vent opening (23) formed in the side panel (22). This configuration reduces the possibility that the slits (26) of the vent opening cover (25) constitute a resistance to air passing through the vent opening (23) formed in the side panel (22).

Figure 12:
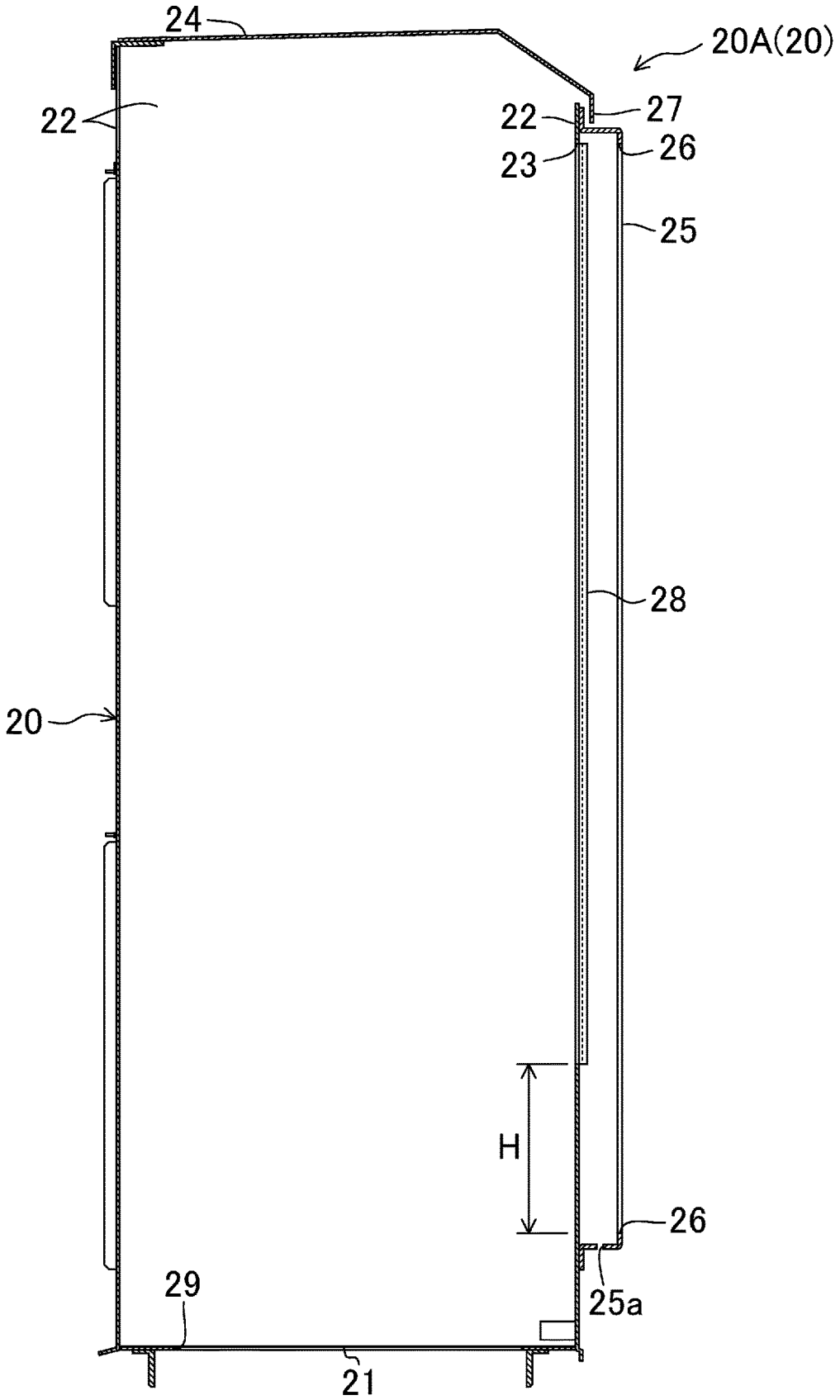
FIG. 12 is a diagram illustrating a vertical cross-sectional view of the electric component box.
Figure 13:
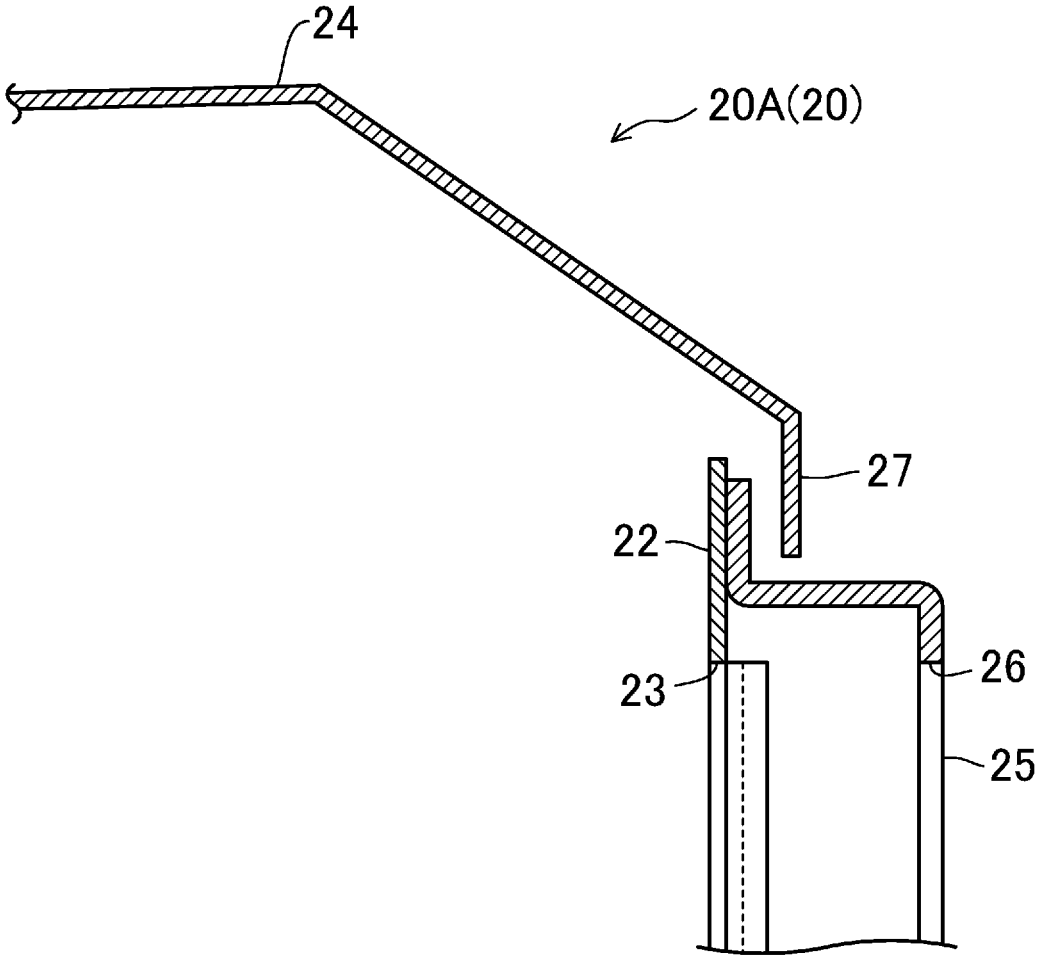
FIG. 13 is a diagram illustrating a partially enlarged view of FIG. 12.

The slits (26) of the vent opening cover (25) are formed such that the lower ends thereof are located below the lower end of the vent opening (23) of the side panel (22) by the dimension H in FIG. 12. Thus, when dew condensation water or rainwater during rainfall drips from the ceiling of the machine chamber (31A to 31D) onto the electric component box (20) and flows along the slits (26), such water flows to the lower ends of the slits (26) and flows further down along the interior or exterior surface of the vent opening cover (25) to a position below the lower end of the vent opening (23). This configuration contributes to reducing the water entering into the electric component box (20) from the opening. Further, a water drain hole (25*a*) is formed in a lower end portion of the vent opening cover (25), so that water in the vent opening cover (25) is drained.

The top panel (24) of the electric component box (20) has a water entry preventing part (27) at its outer edge portion. The water entry preventing part (27) protrudes outward beyond the upper end of the vent opening cover (25) attached to the side panel (22). The water entry preventing part (27) serves as eaves to keep the opening (23) from directly getting wet by dew condensation water or rainwater from outside of the vent opening cover (25).

The electric component box (20) is provided with a water entry inhibiting member (28) which inhibits entry of water into the electric component box (20) from a lateral side of the vent opening (23) of the side panel (22). Specifically, the water entry inhibiting member (28) is comprised of a member having an L-shaped cross section extending in the vertical direction along a side edge of the vent opening (23) formed in the side panel (22). The member is obtained by extrusion of aluminum, for example. The water entry inhibiting member (28) is fixed to the side panel (22) such that one side of the L-shaped member is fixed to the side panel (22).

The bottom panel (21) of the electric component box (20) is provided with an air intake opening (29) through which air flows into the electric component box (20) from outside of the electric component box (20). The air intake opening (29) of the bottom panel (21) allows the vent opening (23) of the side panel (22) to function as an air outlet opening through which air flows out of the interior of the electric component box (20).

<Airflow in Casing>

In this embodiment, the fan (17) rotates to allow air to flow into the machine chamber (31A to 31D) through the air-passage hole (not shown) of the lower casing (40). The air that has flowed into the machine chamber absorbs heat from the compressor (11) and the electric component box (20) to cool them. Further, air flows into the electric component box (20) from the air intake opening (29) formed in the bottom panel (21). The air that has flowed into the electronic component box (20) cools the electronic components in the electric component box (20), and then flows out of the electronic component box (20) into the machine chamber (31A to 31D) from the vent opening (23) of the side panel (22). The air that has cooled the compressor (11) and the electric component box (20) flows into the heat exchange chamber (32A to 32D) through the air vent hole (68) of the cover member (65) covering the opening (61) of the drain pan (60). The air that has flowed into the heat exchange chamber (32A to 32D) exchanges heat with the refrigerant when passing through the first air heat exchanger (15) and the second air heat exchanger (16), and is then discharged outside from the heat exchange chamber (32A to 32D).

Advantages of Embodiment

According to this embodiment, heat generated in the electric component box (20) is dissipated to the outside of the electric component box (20) through the vent opening (23) of the side panel (22) and the slits (26) of the vent opening cover (25). A dedicated fan is not necessary because air flows toward the heat exchange chamber (32A to 32D) from the machine chamber (31A to 31D) and the same air cools the electric component box (20). Further, when water, such as dew condensation water or rainwater during rainfall on the ceiling of the machine chamber (31A to 31D) falls onto the electric component box (20), the water flows downward along the slits (26), so that the water is less likely to enter into the electric component box (20). It is therefore possible to keep the waterproofness from decreasing, while ensuring the heat dissipating properties of the electric component box (20).

In particular, according to the present embodiment, the slits (26) of the vent opening cover (25) are formed such that the lower ends thereof are located below the lower end of the vent opening (23) of the side panel (22) of the electric component box (20). Thus, the water that has fallen onto the electric component box (20) flows down along the slits (26) to the lower ends of the slits (26). As such, even if the water enters the inside of the vent opening cover (25) from the lower ends of the slits (26), the water is less likely to enter into the electric component box (20) from the vent opening (23) which is higher in position than the lower ends of the slits (26). It is therefore possible to effectively keep the waterproofness of the electric component box (20) from decreasing.

According to this embodiment, the opening area of the slits (26) of the vent opening cover (25) is equal to or larger than the opening area of the vent opening (23) formed in the side panel (22) of the electric component box (20). This configuration keeps the resistance of air flowing out of the electric component box (20) from increasing. The heat dissipation of the electric component box (20) is therefore less likely to be inhibited by the vent opening cover (25).

According to this embodiment, the outer edge portion of the top panel (24) constitutes the water entry preventing part (27) which protrudes outward beyond the upper end of the vent opening cover (25). The water entry preventing part (27) serves as eaves. Water falling onto the electric component box (20) from above is therefore less likely to adhere to the side panel (22) and the vent opening cover (25), which keeps the waterproofness of the electric component box (20) from decreasing.

According to this embodiment, even if the water which has fallen onto the electric component box (20) enters the inside of the vent opening cover (25), the water is less likely to enter into the electric component box (20) from a lateral side of the vent opening (23) due to the water entry inhibiting member (28). This configuration contributes to keeping the waterproofness of the electric component box (20) from decreasing. The water entry inhibiting member (28) is comprised of a member having an L-shaped cross section, which contributes to simplifying the structure.

According to this embodiment, air flows into the electric component box (20) through the air intake opening (29) formed in the bottom panel (21) of the electric component box (20), and the air flows out of the electric component box (20) through the vent opening (23) of the side panel (22). The smooth airflow is achieved in this manner. The heat dissipation of the electric component box (20) is therefore increased without a dedicated fan.

OTHER EMBODIMENTS

The above-described embodiment may be modified as follows.

For example, according to the above embodiment, the opening area of the slits (26) of the vent opening cover (25) is equal to or larger than the opening area of the vent opening (23) formed in the side panel (22). If more emphasis is placed on the waterproofness, the opening area of the slits (26) of the vent opening cover (25) may be smaller than the opening area of the vent opening (23) formed in the side panel (22).

The positional relationship between the lower ends of the slits (26) of the vent opening cover (25) and the lower end of the vent opening (23) of the side panel (22) may differ from the positional relationship described in the above embodiment.

The water entry inhibiting member (28) may be formed not in the side panel (22), but in the vent opening cover in the above embodiment.

In the heat source unit of the present disclosure, the water entry preventing part (27) and the water entry inhibiting member (28), for example, may be omitted as long as the vent opening cover (25) is provided with a plurality of slits (26) extending in the vertical direction at positions deviated from the portion opposed to the vent opening (23) of the side panel (22).

INDUSTRIAL APPLICABILITY

As can be seen from the foregoing description, the present disclosure is useful for a heat source unit for a refrigeration device.

DESCRIPTION OF REFERENCE CHARACTERS

1 Chiller Unit (Heat Source Unit)
11 Compressor
15 First Air Heat Exchanger
16 Second Air Heat Exchanger
30 Casing
31A to 31D Machine Chamber
32A to 32D Heat Exchange Chamber
20 Electric Component Box
20A System Electric Component Box
20B Operating Electric Component Box
21 Bottom panel
22 Side panel
23 Vent Opening (Air Outlet Opening)
24 Top Panel
25 Vent Opening Cover
26 Slit
27 Water Entry Preventing Part
28 Water Entry Inhibiting Member
29 Air Intake Opening

The invention claimed is:

1. A heat source apparatus comprising:
a casing including:
a machine chamber in which components, including a compressor, of a refrigerant circuit and an electric component box are disposed; and
a heat exchange chamber in which a heat exchanger allowing heat exchange between a refrigerant and air is disposed,
the casing being configured to allow air to flow from the machine chamber disposed at a lower portion of the casing to the heat exchange chamber disposed above the machine chamber, wherein
the electric component box includes a bottom panel, a side panel which has a lower end connected to the bottom panel and which has a vent opening, a top panel which closes an upper end of the side panel, and a vent opening cover for covering the vent opening of the side panel,
the vent opening cover is provided with a plurality of slits, each extending in a vertical direction and being continuous from an upper end portion to a lower end portion of the vent opening cover, at positions deviated from a portion opposed to the vent opening of the side panel, and
lower ends of the slits of the vent opening cover are located below a lower end of the vent opening of the side panel.

2. The heat source apparatus of claim 1, wherein
an opening area of the slits of the vent opening cover is equal to or larger than an opening area of the vent opening formed in the side panel.

3. The heat source apparatus of claim 2, wherein
the top panel has a water entry preventing part at an outer edge portion, the water entry preventing part protruding outward beyond an upper end of the vent opening cover attached to the side panel.

4. The heat source apparatus of claim 3, wherein
the electric component box is provided with a water entry inhibiting member which inhibits entry of water into the electric component box from a lateral side of the vent opening of the side panel.

5. The heat source apparatus of claim 4, wherein
the water entry inhibiting member is comprised of a member having an L-shaped cross section extending in the vertical direction along a side edge of the vent opening formed in the side panel, and the water entry inhibiting member is fixed to the side panel such that one side of the L-shaped member is fixed to the side panel.

6. The heat source apparatus of claim 4, wherein
the bottom panel is provided with an air intake opening through which air flows into the electric component box from outside of the electric component box;
the vent opening of the side panel of the electric component box is an air outlet opening through which air flows out of an interior of the electric component box.

7. The heat source apparatus of claim 3, wherein
the bottom panel is provided with an air intake opening through which air flows into the electric component box from outside of the electric component box;
the vent opening of the side panel of the electric component box is an air outlet opening through which air flows out of an interior of the electric component box.

8. The heat source apparatus of claim 2, wherein
the electric component box is provided with a water entry inhibiting member which inhibits entry of water into the electric component box from a lateral side of the vent opening of the side panel.

9. The heat source apparatus of claim 8, wherein
the water entry inhibiting member is comprised of a member having an L-shaped cross section extending in the vertical direction along a side edge of the vent opening formed in the side panel, and the water entry inhibiting member is fixed to the side panel such that one side of the L-shaped member is fixed to the side panel.

10. The heat source apparatus of claim 8, wherein
the bottom panel is provided with an air intake opening through which air flows into the electric component box from outside of the electric component box;
the vent opening of the side panel of the electric component box is an air outlet opening through which air flows out of an interior of the electric component box.

11. The heat source apparatus of claim 2, wherein
the bottom panel is provided with an air intake opening through which air flows into the electric component box from outside of the electric component box;
the vent opening of the side panel of the electric component box is an air outlet opening through which air flows out of an interior of the electric component box.

12. The heat source apparatus of claim 1, wherein
the top panel has a water entry preventing part at an outer edge portion, the water entry preventing part protruding outward beyond an upper end of the vent opening cover attached to the side panel.

13. The heat source apparatus of claim 12, wherein
the electric component box is provided with a water entry inhibiting member which inhibits entry of water into the electric component box from a lateral side of the vent opening of the side panel.

14. The heat source apparatus of claim 13, wherein
the water entry inhibiting member is comprised of a member having an L-shaped cross section extending in the vertical direction along a side edge of the vent opening formed in the side panel, and the water entry inhibiting member is fixed to the side panel such that one side of the L-shaped member is fixed to the side panel.

15. The heat source apparatus of claim 13, wherein the bottom panel is provided with an air intake opening through which air flows into the electric component box from outside of the electric component box;

the vent opening of the side panel of the electric component box is an air outlet opening through which air flows out of an interior of the electric component box.

16. The heat source apparatus of claim 12, wherein the bottom panel is provided with an air intake opening through which air flows into the electric component box from outside of the electric component box;

the vent opening of the side panel of the electric component box is an air outlet opening through which air flows out of an interior of the electric component box.

17. The heat source apparatus of claim 1, wherein the electric component box is provided with a water entry inhibiting member which inhibits entry of water into the electric component box from a lateral side of the vent opening of the side panel.

18. The heat source apparatus of claim 17, wherein the water entry inhibiting member is comprised of a member having an L-shaped cross section extending in the vertical direction along a side edge of the vent opening formed in the side panel, and the water entry inhibiting member is fixed to the side panel such that one side of the L-shaped member is fixed to the side panel.

19. The heat source apparatus of claim 17, wherein the bottom panel is provided with an air intake opening through which air flows into the electric component box from outside of the electric component box;

the vent opening of the side panel of the electric component box is an air outlet opening through which air flows out of an interior of the electric component box.

20. The heat source apparatus of claim 1, wherein the bottom panel is provided with an air intake opening through which air flows into the electric component box from outside of the electric component box;

the vent opening of the side panel of the electric component box is an air outlet opening through which air flows out of an interior of the electric component box.

* * * * *